US008506059B2

(12) United States Patent
Hamasaki et al.

(10) Patent No.: US 8,506,059 B2
(45) Date of Patent: Aug. 13, 2013

(54) RECORDING APPARATUS

(75) Inventors: Yuji Hamasaki, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 12/635,982

(22) Filed: Dec. 11, 2009

(65) Prior Publication Data

US 2010/0149288 A1 Jun. 17, 2010

(30) Foreign Application Priority Data

Dec. 15, 2008 (JP) ..... 2008-318567
Oct. 30, 2009 (JP) ..... 2009-250645

(51) Int. Cl.
*B41J 2/18* (2006.01)

(52) U.S. Cl.
USPC ..... 347/85; 347/84; 347/86; 347/89

(58) Field of Classification Search
USPC ..... 347/84, 85, 86, 89
See application file for complete search history.

(56) References Cited

U.S. PATENT DOCUMENTS

2006/0209140 A1* 9/2006 Nagai ..... 347/85
2007/0296747 A1* 12/2007 Inaba et al. ..... 347/12
2008/0151026 A1* 6/2008 Kobayashi ..... 347/92

FOREIGN PATENT DOCUMENTS

JP 61-213159 9/1986
JP 5-177843 7/1993
JP 5-185600 7/1993
JP 5-238017 9/1993
JP 6-155765 6/1994

* cited by examiner

*Primary Examiner* — Jannelle M Lebron
(74) *Attorney, Agent, or Firm* — Canon USA Inc IP Division

(57) ABSTRACT

An ink jet recording apparatus includes a recording head, an ink tank, and two ink routes. The recording head is mounted on a carriage moving along a recording surface of a recording medium and discharges ink and thereby performs recording on the recording medium. The ink tank is disposed inside the recording apparatus and stores ink to be supplied to the recording head. The two ink routes connect the ink tank and the recording head and are capable of circulating ink between the ink tank and the recording head. One of the ink routes is an ink supply path that supplies ink from the ink tank to the recording head, and the other ink route is an ink reflux path that returns ink from the head to the ink tank. The ink reflux path is capable of being fluidly connected to and disconnected from the recording head.

7 Claims, 9 Drawing Sheets

RECORDING APPARATUS

BACKGROUND OF THE INVENTION

1. Field of the Invention

The present invention relates to an ink jet recording apparatus that discharges ink or another liquid onto a recording medium and thereby perform recording, and more specifically, it relates to an ink jet recording apparatus configured to circulate ink between an ink supply source and a recording head.

2. Description of the Related Art

In some ink jet recording apparatuses, a main ink tank is mounted not on a carriage but on a main body of the ink jet recording apparatus, and ink is supplied from the main ink tank, for example, through a tube, to a recording head mounted on the carriage. This system will be referred to as off-carriage tank system for descriptive purposes.

The off-carriage tank system is advantageous in that a carriage does not require a large space for disposing a main ink tank, and a large amount of ink to be supplied to a recording head can be stored without putting a heavy load on the scanning of the carriage.

However, it is known that, since this system includes a tube, ink evaporates from the tube and thereby thickens, air enters the tube and generates bubbles, and this affects the discharge of ink. In the case of pigment ink, pigment precipitates, for example, due to prolonged disuse, and the density of ink is thereby varied. To solve these problems, a recovery operation is performed in which a recording head is covered with a cap, the recording head is depressurized through the cap, ink is thereby sucked out of nozzles of the recording head, and thickened ink, bubbles, or precipitated pigment is discharged from the recording head together with ink. However, in such a recovery operation, ink discharged together with the harmful substances is wasted. This is one of problems to be solved.

There is proposed an ink jet recording apparatus in which an ink tank and a recording head are connected by an ink supply tube from the ink tank to the recording head and an ink reflux tube from the recording head to the ink tank. In this configuration, ink discharged from the recording head together with thickened ink, bubbles, or precipitated pigment is returned to the ink tank by circulating ink. Therefore, the waste of ink is prevented.

The configuration of circulatory supply has room for improvement, for example, in the arrangement of the tubes connecting the recording head and the ink tank. Since the tubes are moved or displaced with the scanning of the carriage, a space in which the tubes are moved needs to be secured. This leads to an increase in the size of the recording apparatus. In addition, the load on the carriage increases due to the movement or displacement of the tubes, and therefore a structure is required that can withstand the increased load (for example, use of a large motor).

To solve these problems, Japanese Patent Laid-Open No. 61-213159 discloses a configuration in which a sub-tank is mounted on a carriage, a circulatory ink supply route is divided into two sections, and the sections are connected as needed to supply ink. In this configuration, bubbles and the like are recovered to an ink tank together with circulated ink, and ink is not discharged wastefully, and in addition, the use of tubes does not affect the driving of the carriage.

However, in the configuration in which a circulatory ink supply route is divided, the connection and disconnection of sections depends on the demand of the head for replenishment with ink, and frequently connecting and disconnecting the sections leads to a decrease in recording speed. To reduce the frequency of connecting and disconnecting operations, the size of the sub-tank needs to be increased. However, increasing the size of the sub-tank increases the load on the carriage and makes this configuration meaningless. In addition, the configuration in which a supply-side tube and a circulation-side tube are connected and disconnected at the same time can increase the size of the ink jet recording apparatus in view of the structure and operation load.

SUMMARY OF THE INVENTION

The present invention provides an ink jet recording apparatus in which the load on the carriage can be reduced without increasing the size of the ink jet recording apparatus and that can perform high-speed recording without being limited by the supply of ink. In addition, the present invention provides an ink jet recording apparatus in which harmful substances generated in the recording head (and its vicinity) can be appropriately eliminated while reducing wasted ink.

In an aspect of the present invention, an ink jet recording apparatus includes a carriage, a recording head, an ink tank, and two ink routes. The recording head is mounted on the carriage moving along a recording surface of a recording medium and discharges ink and thereby performs recording on the recording medium. The ink tank is disposed inside the recording apparatus and stores ink to be supplied to the recording head. The two ink routes connect the ink tank and the recording head and facilitate circulating ink between the ink tank and the recording head. One of the ink routes is an ink supply path that supplies ink from the ink tank to the recording head, and the other ink route is an ink reflux path that returns ink from the recording head to the ink tank. The ink reflux path can be fluidly connected to and disconnected from the recording head.

Further features of the present invention will become apparent from the following description of exemplary embodiments with reference to the attached drawings.

DESCRIPTION OF THE EMBODIMENTS

First Embodiment

Figure 1:
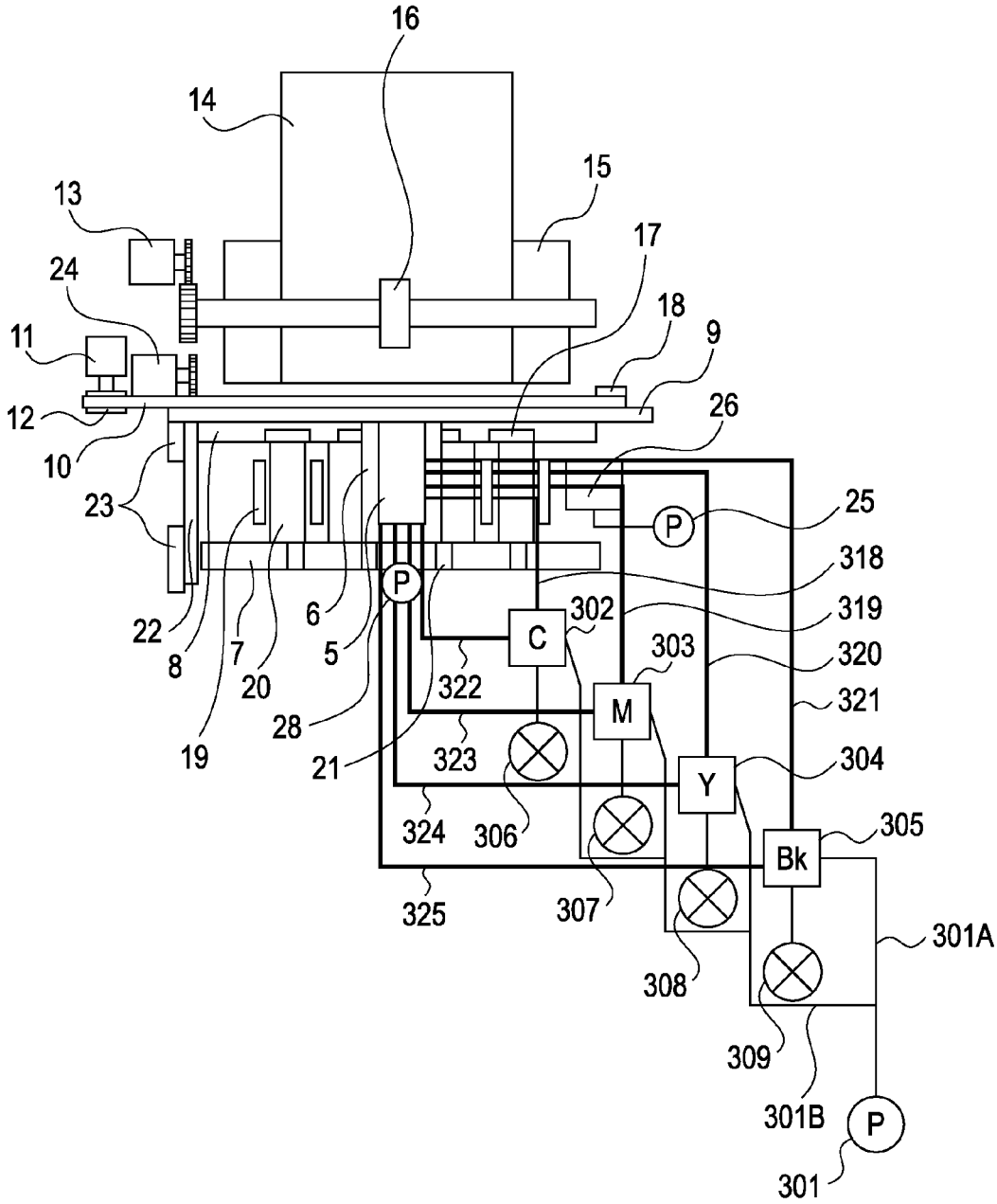
FIG. 1 is a schematic view showing the configuration of an ink jet recording apparatus according to an embodiment.

FIG. 1 is a schematic view of an ink jet recording apparatus according to a first embodiment.

In FIG. 1, recording heads 5 are mounted on a carriage 6. The recording heads 5 each have a recording head unit that has a plurality of recording elements for discharging liquid such as ink in the form of droplets from discharge ports. The recording heads 5 each further have a reservoir (sub-tank) for storing ink sent from main tanks 302 to 305 and replenishing the recording elements with ink.

In addition, the recording heads 5 are each provided with a connector for transmitting and receiving signals, such as a signal that drives the head portion. The carriage 6 is provided with connector holders for transmitting a drive signal and the like to the recording heads 5 through the connectors.

Reference numeral 9 denotes a guide shaft placed in the apparatus main body. The carriage 6 is guided and supported by the guide shaft 9 along the direction in which the guide shaft 9 extends, and can reciprocate in the main scanning direction shown by the arrow in FIG. 1.

The carriage 6 is moved along the guide shaft 9 by a drive unit including a motor pulley 12, a driven pulley 18, a timing belt 10, and a main scanning motor 11. The position of the carriage 6 is detected by a linear encoder. On the basis of a detection signal of the linear encoder, the position and travel distance of the carriage 6 are controlled.

Recording media 14 are loaded on an automatic sheet feeder 15. At the start of recording, a paper feed motor 13 is driven. This driving force is transmitted through a gear train 13A to a pickup roller 16. This rotates the pickup roller 16. The recording media 14 are fed from the automatic sheet feeder 15 one at a time into the recording apparatus.

The fed recording medium 14 is conveyed by the rotative force of a conveying roller 8. The conveying roller 8 is rotated by the rotative force generated by a conveying motor 24 and transmitted through gears. The conveying roller 8 is connected by a belt member 22 to a driven roller 7. The rotation of the conveying roller 8 rotates the driven roller 7. A code wheel 23 is attached to the conveying roller 8. A rotation angle sensor (not shown) detects slits formed in the code wheel 23. The amount of rotation and speed of rotation of the conveying roller 8 are controlled by feeding back a detection signal of the rotation angle sensor to a driver for controlling the conveying motor 24.

When the recording medium 14 is conveyed between the conveying roller 8 and the driven roller 7, the recording medium 14 is supported by a platen 19 so as to form a flat recording surface at a position facing the recording heads 5. When the recording medium 14 passes under the recording heads 5, the recording heads 5 discharge ink onto the recording medium 14 according to a predetermined image signal. A pinch roller 17 and a spur roller 21 are auxiliary rollers for improving the ability to hold the recording medium 14.

Between the conveying roller 8 and the driven roller 7 is an ink absorber 20. In the case of borderless recording, spilled ink is absorbed by the ink absorber 20, and the platen is therefore prevented from being contaminated. Reference numeral 26 denotes a cap. When printing is not being performed, the cap 26 is brought into contact with nozzles to prevent drying of the nozzles. Reference numeral 25 denotes a suction pump for sucking ink out of the nozzles through the cap 26.

Figure 2:
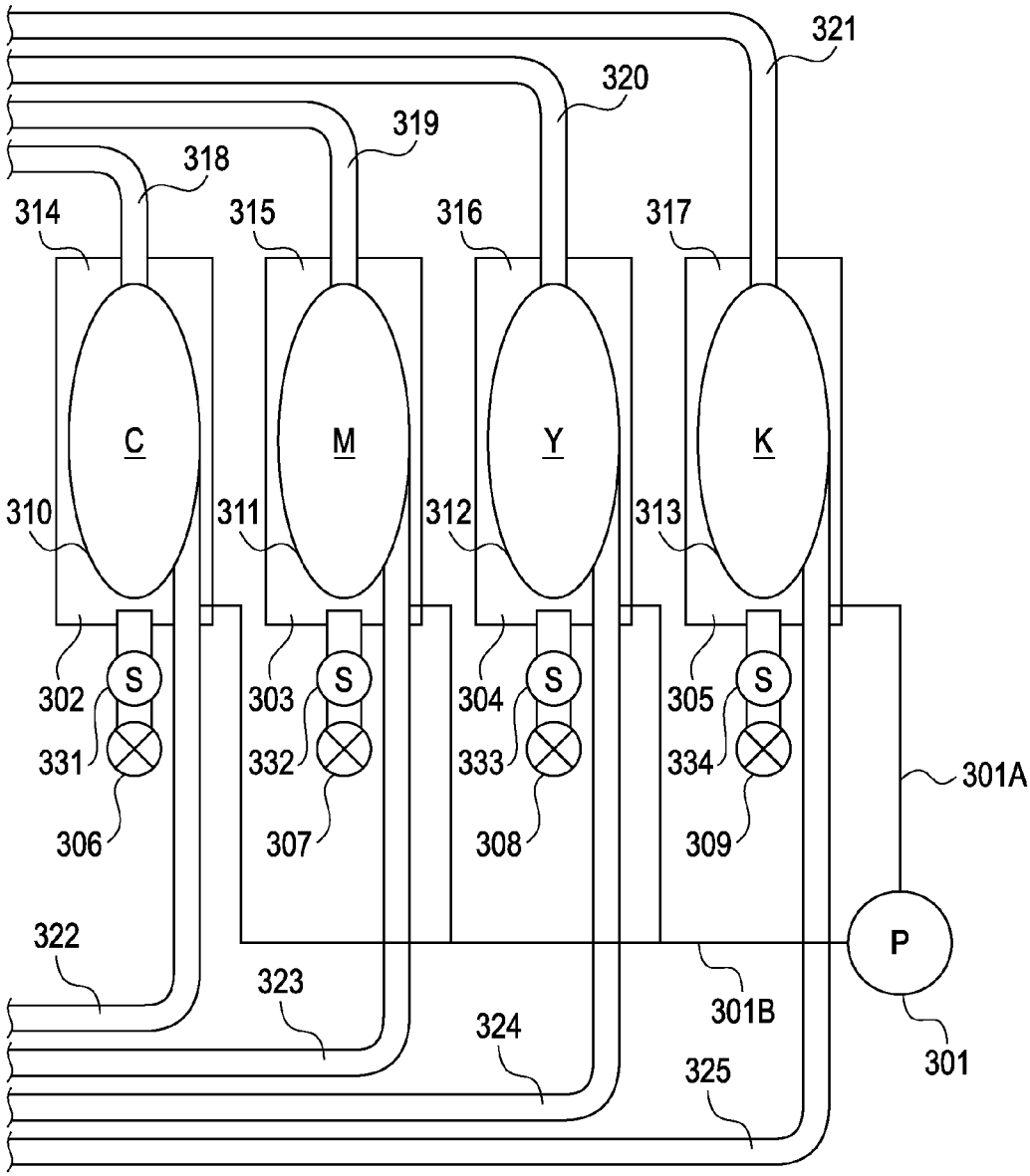
FIG. 2 shows the configuration of main tanks.

FIG. 2 shows the details of the main tanks 302 to 305. Reference numeral 301 denotes a pressurizing pump, which is shared by four ink tanks: a cyan ink tank 302, a magenta ink tank 303, a yellow ink tank 304, and a black ink tank 305. Reference numerals 306, 307, 308, and 309 denote atmosphere communication valves connected to the ink tanks. The atmosphere communication valves 306, 307, 308, and 309 bring the ink tanks 302, 303, 304, and 305, respectively, into or out of communication with the atmosphere.

Reference numerals 310, 311, 312, and 313 denote ink bags that hold ink. Between the ink bags 310, 311, 312, and 313 and tank walls are spaces 314, 315, 316, and 317. Air is sent through flow paths 301A and 301B to the spaces from the pressurizing pump 301.

Ink supply tubes 318, 319, 320, and 321 serving as ink supply paths (hereinafter referred to as supply paths) connect the ink bags to the recording heads 5. Ink reflux tubes 322, 323, 324, and 325 serving as ink reflux paths (hereinafter referred to as reflux paths) are connected to the ink bags 310, 311, 312, and 313, respectively, or ink tank cases that communicate with the ink bags. The ink supply paths and ink reflux paths serve as ink routes. Since the spaces between the ink bags and the tank walls are pressurized regions, the junctions between the ink reflux tubes and the ink tanks need to be hermetically sealed.

The other ends of the ink reflux tubes 322, 323, 324, and 325 are selectively fluidly connected to and disconnected from the recording heads 5 as described below.

Since the ink tanks have the same function, only the cyan ink tank 302 will be described. First, the pressurizing pump 301 is driven with the atmosphere communication valve 306 closed. The air in the space 314 between the ink bag 310 and the wall of the ink tank 302 is pressurized and presses the ink bag 310. By pressing the ink bag 310, the ink inside is sent through the ink supply tube 318 to the recording head 5.

Then, the atmosphere communication valve 306 is opened. Since the air in the space 314 between the ink bag 310 and the wall of the ink tank 302 is brought under atmospheric pressure, the ink bag is no longer pressed. The atmosphere communication valves 306, 307, 308, and 309 for the ink tanks can be separately opened and closed, and therefore the pressures in the ink tanks can be separately controlled. The ink tanks or the supply paths are desirably provided with pressure detectors 331, 332, 333, and 334. On the basis of the outputs from the pressure detectors, the supply pressures can be regulated. The outputs from the pressure detectors can be used as timing triggers at the time of cleaning.

By actuating a reflux pump (for example, a depressurizing pump) 28 shown in FIG. 1, ink and bubbles are sent from the recording head 5 through the ink reflux tube 322 to the ink bag 310 in the ink tank 302. At this time, the pressurizing pump 301 for supplying ink is also actuated, and ink is sent from the ink tank 302 through the ink supply tube 318 to the recording head 5. By driving the depressurizing pump 28 and the pressurizing pump 301 at the same time, ink is circulated through the ink tank 302, the ink supply tube 318, the recording head 5, and the ink reflux tube 322.

Figure 3:
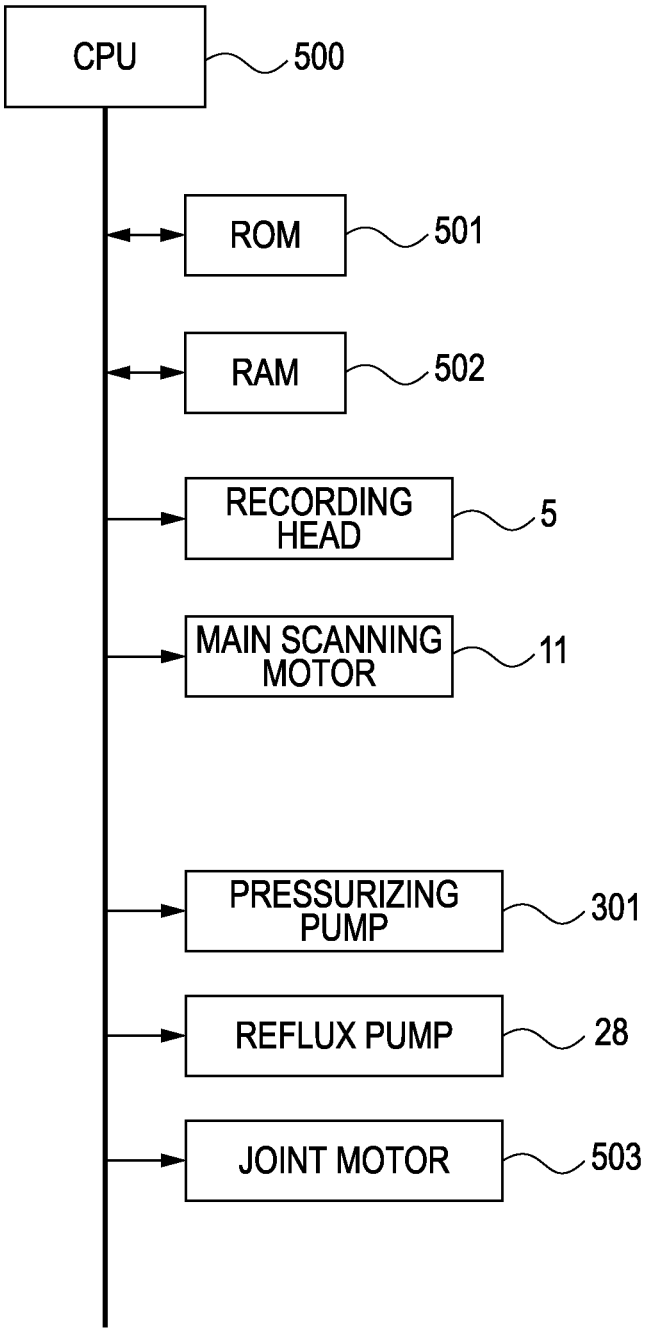
FIG. 3 shows the circuit configuration of this embodiment.

FIG. 3 shows the circuit configuration of this embodiment.

In FIG. 3, reference numeral 500 denotes a CPU that controls the recording apparatus and issues various control commands, reference numeral 501 denotes a ROM in which control programs, control data, and the like are written, and reference numeral 502 denotes a RAM that serves as an area for developing recording data or the like.

Figure 4:
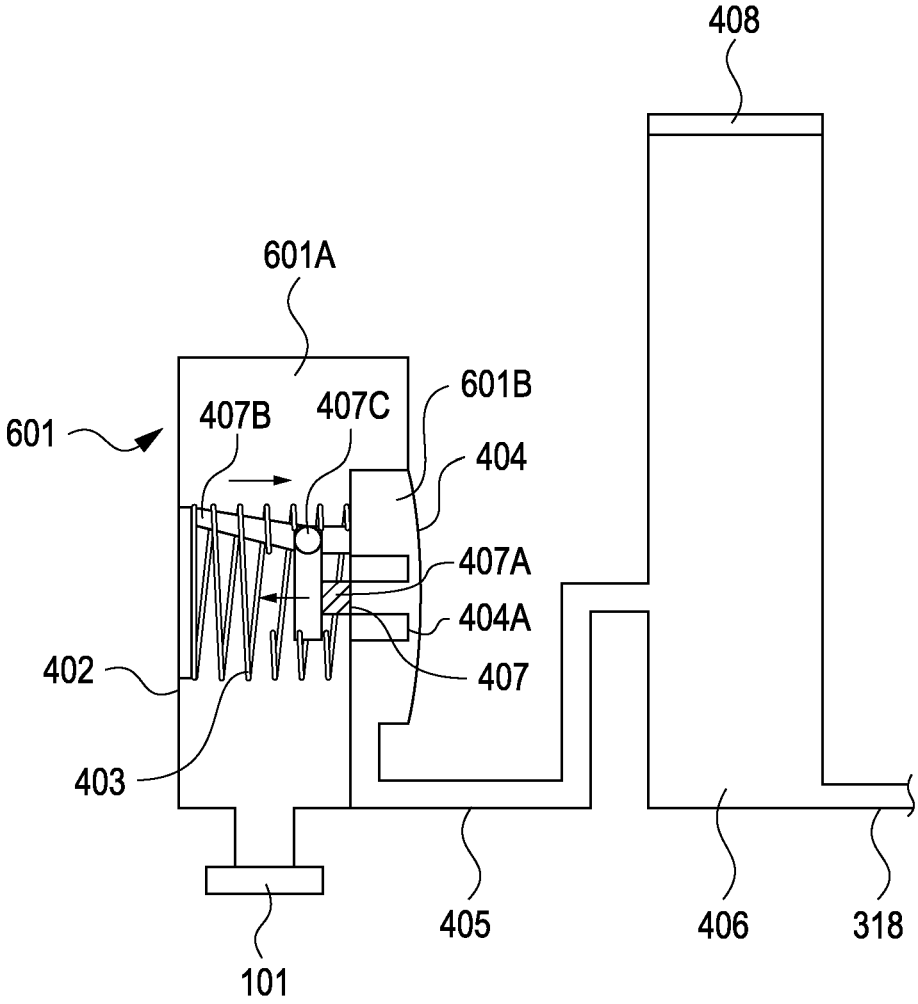
FIG. 4 shows the configuration of a sub-tank.

Next, sub-tanks mounted on the carriage 6 will be described in detail. Since the sub-tanks have the same configuration, only the cyan ink sub-tank 601 will be shown in FIG. 4. The sub-tanks supply ink to the plurality of recording heads 5 mounted on the carriage 6. The sub-tanks are necessary to maintain negative pressure in the recording heads and to properly supply ink.

The sub-tank 601 has a negative pressure chamber 601A and a choke valve 601B.

Reference numeral 101 denotes a chip with a plurality of recording nozzles having discharge ports discharging ink supplied from the negative pressure chamber 601A of the sub-tank 601.

Part of the outer wall of the negative pressure chamber 601A is formed of a flexible film 402. The flexible film 402 is urged by a spring 403 so as to increase the volume of the negative pressure chamber 601A, thereby maintaining the inside of the negative pressure chamber 601A under negative pressure.

The ink supply tube 318 communicates with a bubble buffer chamber 406. Bubbles in ink flowing through the ink supply tube 318 are trapped in the bubble buffer chamber 406 so as not to flow into the sub-tank 601. The upper wall of the bubble buffer chamber 406 is formed of a gas-liquid separation film 408. The gas-liquid separation film 408 transmits gas but does not transmit liquid. By the pressure at the time of supply, only air can be discharged from the ink flow path through the gas-liquid separation film 408.

The bubble buffer chamber 406 is connected by an ink flow path tube 405 to the choke valve 601B of the sub-tank 601.

Part of the outer wall of the choke valve 601B is formed of a flexible film 404. When the pressure in the choke valve 601B is lower than the atmospheric pressure, the film 404 is pressed by the atmospheric pressure against a valve seat 404A, and the valve is closed. When the pressure in the choke valve 601B is made higher than the atmospheric pressure by ink supplied through the ink flow path tube 405, the film 404 is separated from the valve seat 404A, and the valve is opened.

To control the amount of ink in the negative pressure chamber 601A, the negative pressure chamber 601A is connected to the choke valve 601B through a supply control valve 407. The supply control valve 407 has an L-shaped lever 407B that is rotatable about a pivot shaft 407C, and a valve member 407A that is attached to the L-shaped lever 407B and blocks the communication. As ink is consumed, the flexible film 402 moves so as to reduce the volume of the negative pressure chamber 601A while compressing the spring 403, and the flexible film 402 presses the L-shaped lever 407B in the direction of the arrow in FIG. 4. Pressed by the flexible film 402, the L-shaped lever 407B rotates clockwise about the shaft 407C, and the valve member 407A attached to the L-shaped lever 407B leaves the valve seat and opens the supply control valve 407.

The opened supply control valve 407 introduces ink into the negative pressure chamber 601A. As the negative pressure chamber 601A is filled with ink, the flexible film 402 moves so as to increase the volume of the negative pressure chamber 601A. The L-shaped lever 407B rotates counterclockwise, and the valve member 407A closes the valve. During the recording operation, the pressure in the sub-tank is properly maintained by the above series of operations, and ink is supplied to the discharge nozzles.

In this embodiment, the sub-tank 601 and the bubble buffer chamber 406 are parts of the recording head. However, the sub-tank 601 and the bubble buffer chamber 406 may be mounted on the carriage separately from the recording head and may form parts of the ink supply path.

Figure 5A:
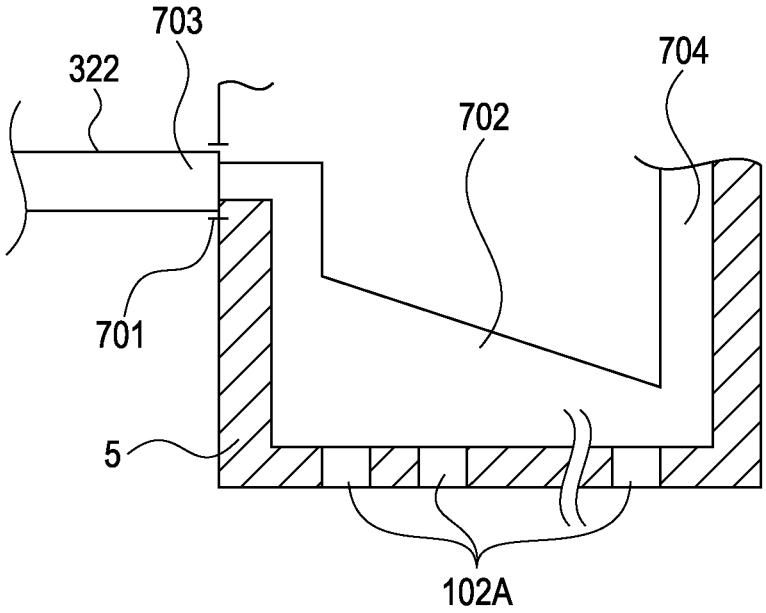
FIG. 5A shows the connected state of the ink reflux path used in a first embodiment of the present invention.
Figure 5B:
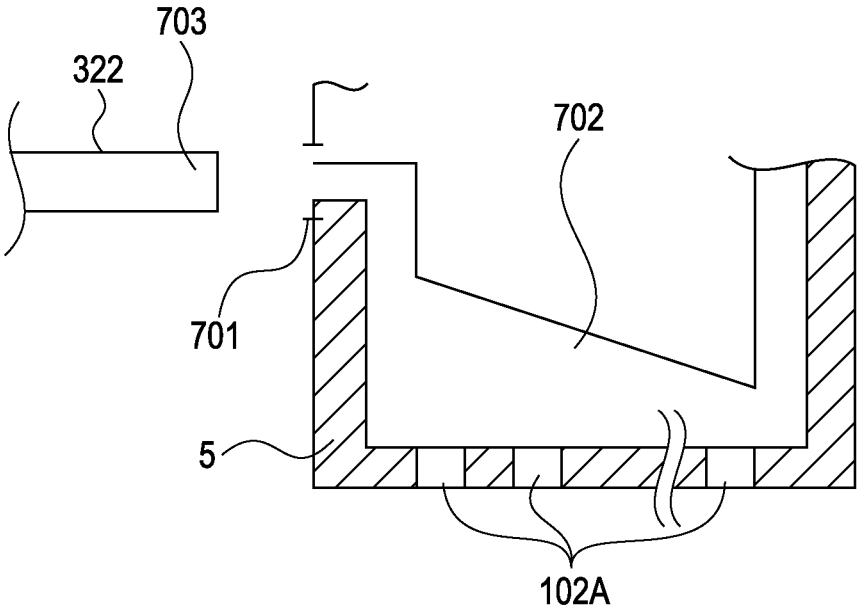
FIG. 5B shows the unconnected state of the ink reflux path used in a first embodiment of the present invention.

FIGS. 5A and 5B are schematic sectional views showing the connection and relationship between the recording head unit and the reflux tube used in this embodiment. Since the relationship between the recording head and the reflux tube is the same regardless of color, only cyan will be described.

A common ink chamber 702 provided in the recording head 5 has an ink supply port 704 and a plurality of ink discharge ports 102A. The ink discharge ports 102A are nozzles.

A reflux connector 703 is provided at the end of the ink reflux tube 322. A supply connector 701 is provided in the recording head 5. The reflux connector 703 and the supply connector 701 form a junction. By joining the reflux connector 703 and the supply connector 701 at the junction, the ink reflux tube 322 is connected to the recording head 5. FIG. 5A shows a state where the ink reflux tube 322 and the recording head 5 are connected at the junction. FIG. 5B shows a state where the ink reflux tube 322 and the recording head 5 are not connected.

The supply connector 701 and the reflux connector 703 are each a valve joint that has an opening and closing valve at the open end thereof. In the connected state shown in FIG. 5A, the opening and closing valves of the supply connector 701 and the reflux connector 703 are both open and allow ink to be sent. In the unconnected state shown in FIG. 5B, the opening and closing valves of the supply connector 701 and the reflux connector 703 are both closed and prevent ink from leaking and air from entering through the openings of the valve joints.

The reflux connector 703 of the ink reflux tube 322 is supported together with the joints of the other ink reflux tubes by a supporting member such as a plate. The joints of the ink reflux tubes may be supported by separate supporting members. The supporting member that supports the reflux connector 703 is movably supported by a guide. A joint motor 503 moves the supporting member along the guide. The guide, the supporting member, and the joint motor 503 constitute a moving unit that moves the reflux connector 703 along the guide.

The moving unit moves the reflux connector 703 along the guide, and the reflux connector 703 is thereby connected to the supply connector 701 at a stop in the home position.

The reflux connector 703 is connected to the supply connector 701 when the carriage is located in a predetermined position such as the home position. In the home position, suction by the cap 26 and wiping are performed for the recovery of the recording head 5.

By connecting the reflux connector 703 to the supply connector 701 and actuating the depressurizing pump 28 for reflux and the pressurizing pump 301 for ink supply, ink is circulated. In the case where the pressurizing pump 301 and the depressurizing pump 28 are driven at the same time, pressure of pressurizing pump minus pressure of depressurizing pump must be higher than withstanding pressure of nozzles but lower than 0 mmAq. When this condition is satisfied, ink can be prevented from dripping from the nozzles, and air can be prevented from entering through the nozzles.

By circulating ink, ink and bubbles are sent from the recording head 5 through the ink reflux tube 322 to the ink bag 310 in the ink tank 302. At the same time, ink is sent from the ink tank 302 through the ink supply tube 318 to the recording head 5.

Ink is circulated when the amount of bubble or the degree of precipitation and evaporation of ink in all ink supply paths including the ink supply tube, recording head, and ink reflux tube exceeds a predetermined threshold value. On the basis of the amount of time that printing is not being performed, the number of times ink tanks are replaced, and the like, the timing to circulate ink is determined.

In conventional ink jet recording apparatuses, bubbles in the common ink chamber 702 and in the vicinity of the ink discharge ports 102 in the recording head are sucked with a cap through the ink discharge nozzles and gotten rid of as wasted ink. However, by circulating ink, bubbles are removed through the ink reflux tube 322 from the common ink chamber 702 and the vicinity of the ink discharge ports 102 and are sent to the ink tank 302. In addition, precipitated ink and evaporated ink are also sent to the ink tank 302 and mixed with the ink in the ink tank 302. Therefore, the degree of precipitation and evaporation are reduced.

After the completion of above-described ink circulation, as shown in FIG. 5B, the ink reflux tube 322 and the recording head 5 are disconnected and do not put a load on the carriage 6 scanning in the main scanning direction during the recording operation. Therefore, the scanning speed, acceleration, and deceleration of the carriage 6 for high-speed printing are unaffected. In this configuration, the ink supply tube is always connected, and therefore the ink supply is not limited. The demand of the recording head for ink can be satisfactorily met without increasing the size of the sub-tank. Recording is not interfered with. This configuration is capable of high-speed recording. Since the ink reflux tube is connected only when needed, the frequency of connections is appropriate, the time required for connection is short, and therefore high-speed recording can be performed. This configuration can reduce the load on the carriage without increasing the size of the ink jet recording apparatus and can perform high-speed recording without being limited by the supply of ink. In addition, bubbles, thickened ink, and precipitation of pigment in the recording head (and its vicinity) can be appropriately eliminated while reducing wasted ink.

Second Embodiment

Figure 6A:
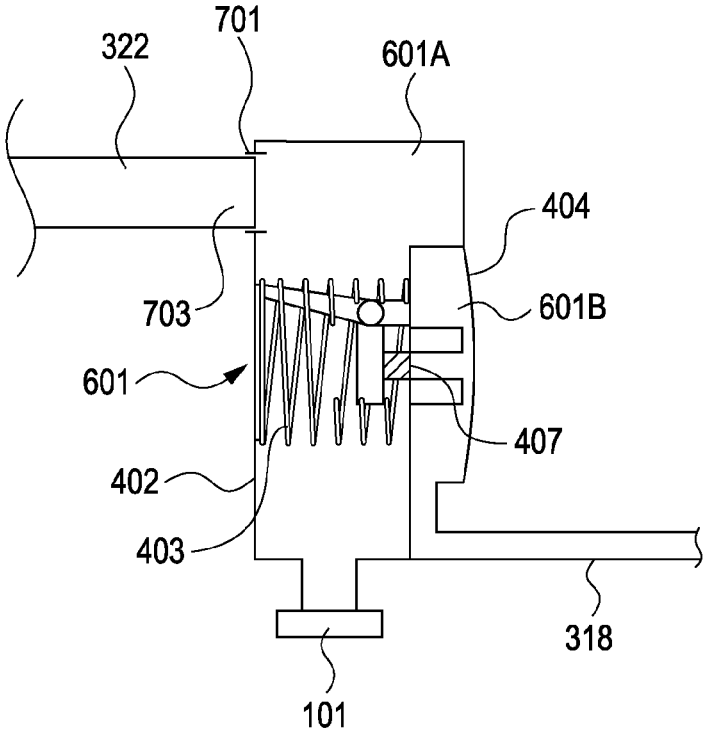
FIG. 6A shows the connected state of the ink reflux path used in a second embodiment of the present invention.
Figure 6B:
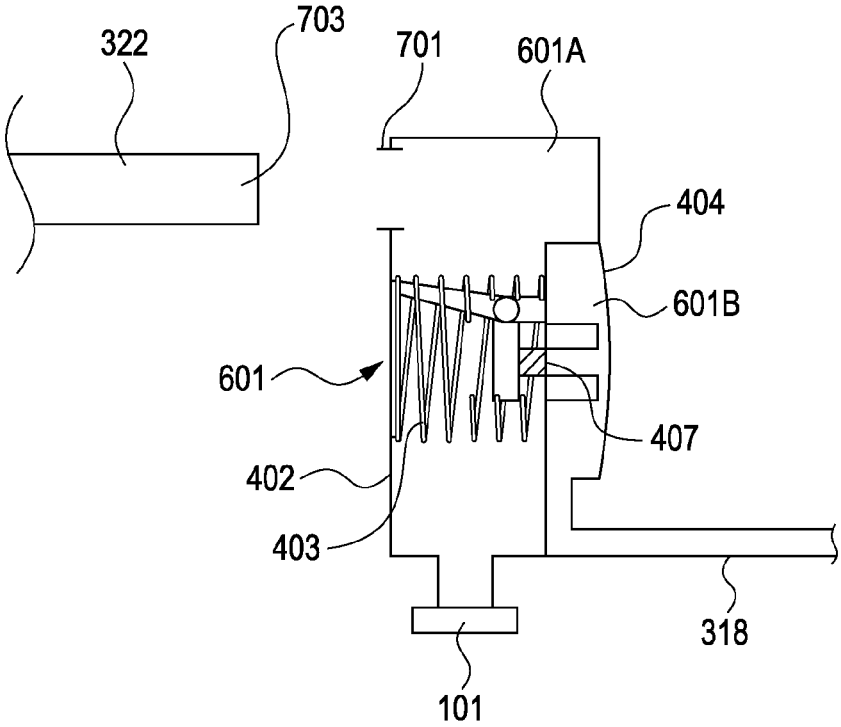
FIG. 6B shows the unconnected state of the ink reflux path used in a second embodiment of the present invention.

FIGS. 6A and 6B are schematic sectional views showing the connection and relationship between the sub-tank and the reflux tube used in a second embodiment. Since the relationship between the recording head and the reflux tube is the same regardless of color, only cyan will be described.

In the second embodiment, a bubble buffer chamber is not provided, and the ink supply tube 318 is directly connected to the choke valve 601B. The supply connector 701 is provided in the negative pressure chamber 601A.

When the recording head 5 is in the home position, the reflux connector 703 is moved and connected to the supply connector 701.

The timing to perform the circulating operation is the same as the first embodiment.

Third Embodiment

Figure 7A:
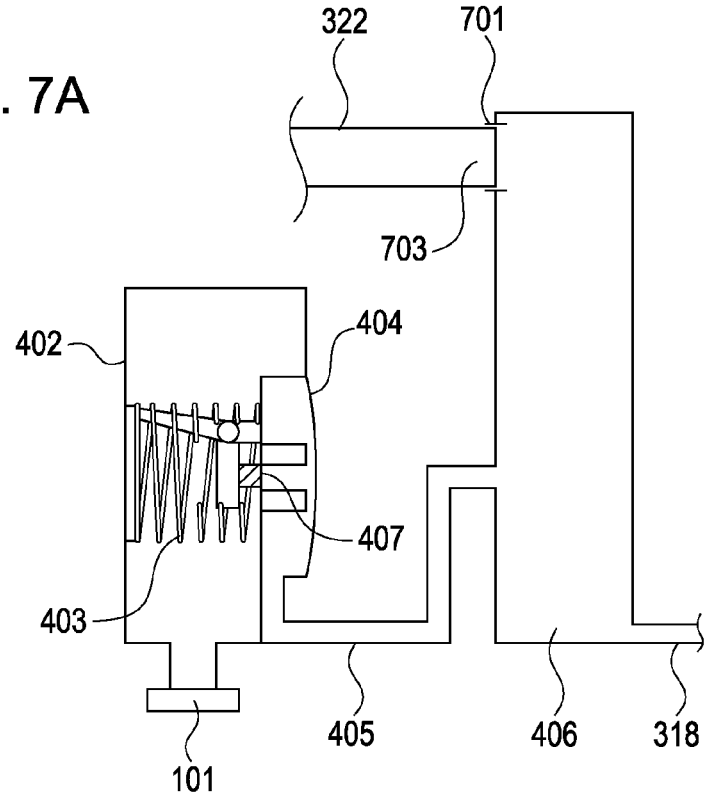
FIG. 7A shows the connected state of the ink reflux path used in a third embodiment of the present invention.
Figure 7B:
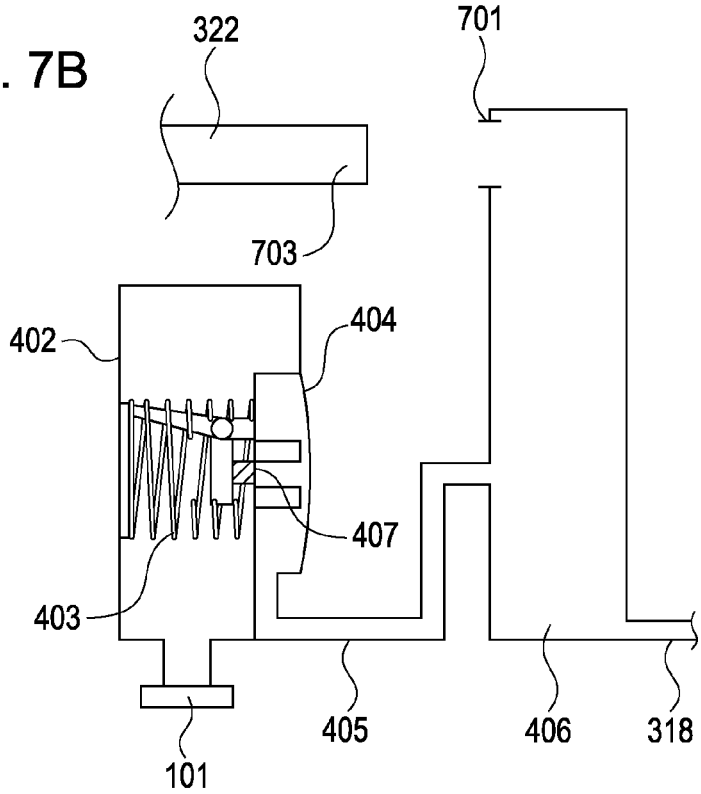
FIG. 7B shows the unconnected state of the ink reflux path used in a third embodiment of the present invention.

FIGS. 7A and 7B are schematic sectional views showing the connected state and relationship of the reflux tube of a third embodiment in which the bubble buffer chamber 406 is not provided with a gas-liquid separation film 408. The basic configuration is the same as the first embodiment. In the case of this embodiment, the degree of evaporation and precipitation of ink is reduced by circulation, and therefore evaporated and precipitated ink can be reused. However, bubbles need to be discharged from the bubble buffer through the ink discharge nozzles by depressurizing the cap 26 with the suction pump 25. Although this embodiment is less effective at reducing wasted ink than the first embodiment, this embodiment is advantageous in that the durability and chemical resistance of the gas-liquid separation film need not be considered and there is a high degree of freedom in the choice of ink.

Fourth Embodiment

Figure 8A:
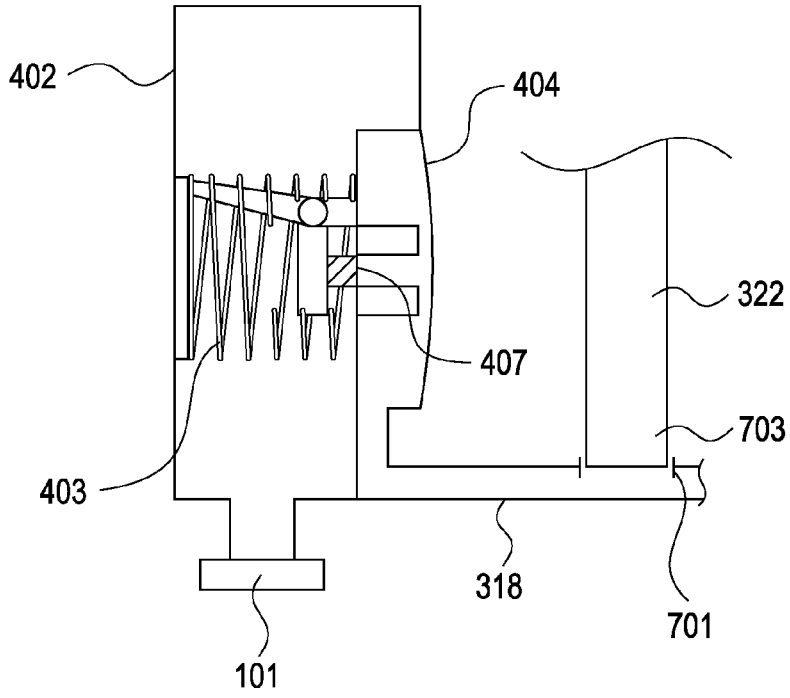
FIG. 8A shows the connected state of the ink reflux path used in a fourth embodiment of the present invention.
Figure 8B:
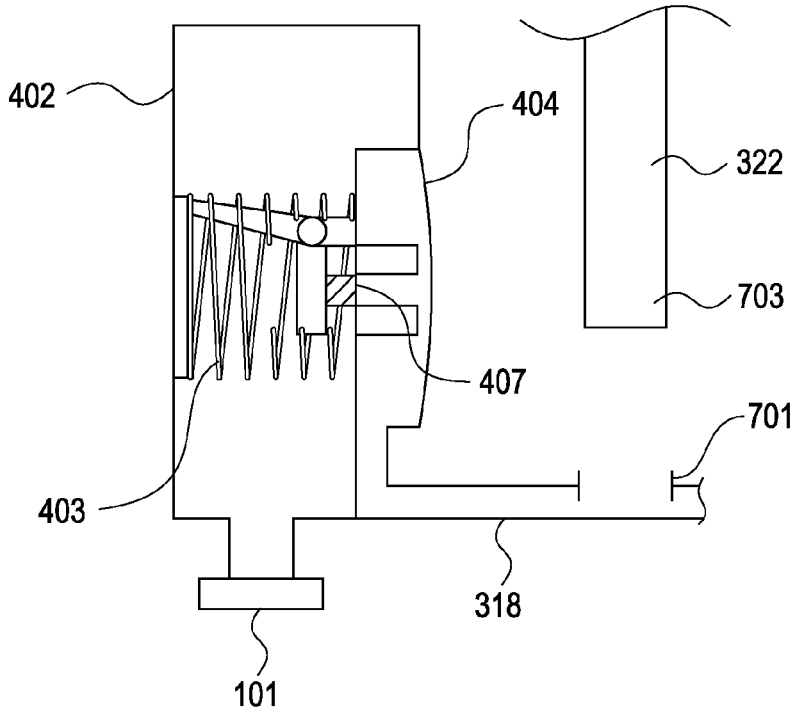
FIG. 8B shows the unconnected state of the ink reflux path used in a fourth embodiment of the present invention.

FIGS. 8A and 8B are schematic sectional views showing the connected state and relationship of the reflux tube used in a fourth embodiment. Since the relationship between the recording head and the reflux tube is the same regardless of color, only cyan will be described.

The reflux connector 703 provided in the ink reflux tube 322 is fitted into the supply connector 701 provided in the ink supply tube 318. The ink supply tube 318 is fixed to the sub-tank 601. The supply connector 701 that the ink supply tube 318 has may be provided, for example, in a plate for fixing between the ink supply tube 318 and the sub-tank 601. Although not shown, the configuration of FIGS. 8A and 8B may have a bubble buffer chamber between the ink supply tube and the sub-tank.

Fifth Embodiment

Figure 9A:
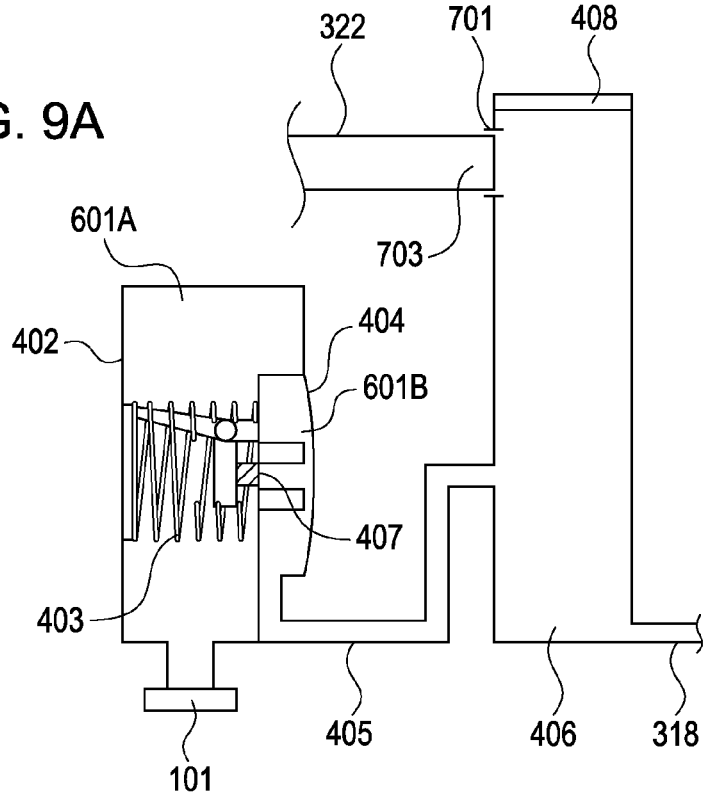
FIG. 9A shows the connected state of the ink reflux path used in a fifth embodiment of the present invention.
Figure 9B:
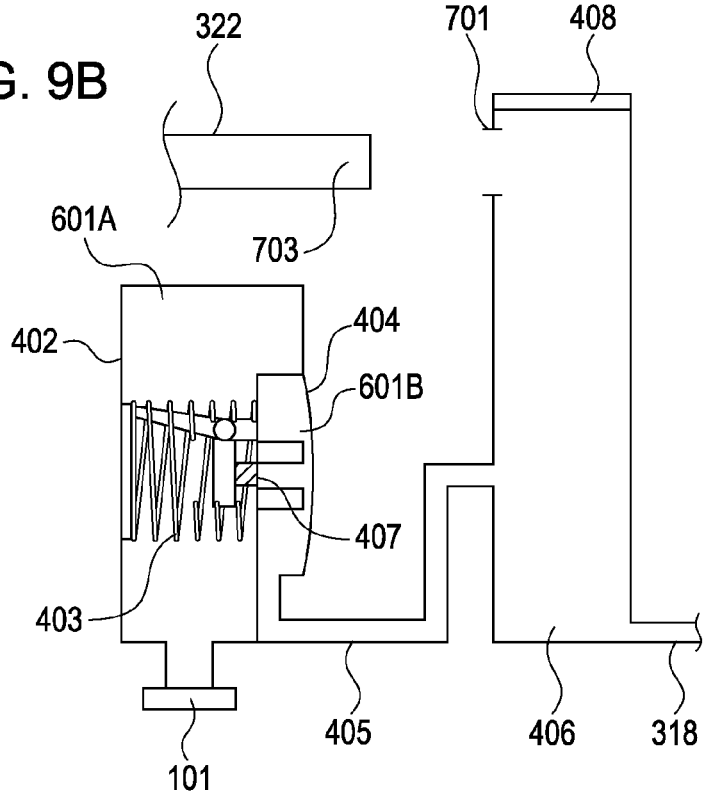
FIG. 9B shows the unconnected state of the ink reflux path used in a fifth embodiment of the present invention.

FIGS. 9A and 9B are schematic sectional views showing the connected state and relationship of the reflux tube used in a fifth embodiment. Since the relationship between the recording head and the reflux tube is the same regardless of color, only cyan will be described.

In the fifth embodiment, a bubble buffer chamber 406 that serves as a buffer space capable of trapping bubbles and the like is provided in the ink supply path near the recording head 5. The bubble buffer chamber is a bubble-storing chamber (buffer space) that has a space extending upward, in the direction opposite to the direction of gravitational force, from the ink supply path and traps bubbles coming through the supply path in this space. The bubble buffer chamber is provided with a gas-liquid separation film 408. In this example, bubbles are discharged through the gas-liquid separation film. The purpose of circulating ink through the reflux path is to eliminate thickened ink, precipitated pigment in ink, and the like. In this embodiment, the supply connector 701 is provided in the bubble buffer chamber 406.

When the recording head 5 is in the home position, the reflux connector 703 is moved and connected to the supply connector 701.

The timing to perform the circulating operation is the same as the first embodiment.

By adopting any one of the above configurations, in an off-carriage configuration, it becomes possible to circulate bubbles and evaporated, thickened, and precipitated ink in the recording head and the ink flow paths, and it becomes possible to remove bubbles and to agitate and reuse evaporated ink, thickened ink, and precipitated ink. Since the ink reflux paths are connected to the carriage or the recording heads only during ink circulation, the ink reflux paths do not put a load during the recording operation. Thus, high-speed recording performance is maintained while reducing wasted ink and operating cost by removing bubble and reusing ink.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-318567 filed Dec. 15, 2008 and No. 2009-250645 filed Oct. 30, 2009, which are hereby incorporated by reference herein in their entirety.

What is claimed is:

1. An ink jet recording apparatus comprising:

a recording head configured to discharge ink;

a carriage configured to move with the recording head mounted thereon;

an ink tank that stores ink to be supplied to the recording head;

a first path through which ink is supplied from the ink tank to the recording head;

a second path through which ink is returned from the recording head to the ink tank, the second path being able to be in a first state of connecting to the recording head and be in a second state of disconnecting from the recording head; and a switching unit configured to switch between a state in which the first path is connecting to the recording head and the second path is in the first state so that the first path and the second path follow a movement of the carriage and a state in which the first path is connecting to the recording head and the second path is in the second state so that only the first path follows a movement of the carriage.

2. The ink jet recording apparatus according to claim 1, wherein the second path is connected when a demand for circulation of ink in the recording head is made, and is disconnected after the circulation of ink is performed.

3. The ink jet recording apparatus according to claim 1, wherein the recording head has discharge ports that discharge ink and a common liquid chamber that stores ink to be supplied to the discharge ports, and the second path is connected to and disconnected from the common liquid chamber.

4. The ink jet recording apparatus according to claim 1, wherein the recording head has discharge ports that discharge ink, a common liquid chamber that stores ink to be supplied to the discharge ports, and a negative pressure chamber that generates negative pressure to be exerted on the discharge ports, and the second path is connected to and disconnected from the negative pressure chamber.

5. The ink jet recording apparatus according to claim 1, wherein the recording head has discharge ports that discharge ink, a common liquid chamber that stores ink to be supplied to the discharge ports, a negative pressure chamber that generates negative pressure to be exerted on the discharge ports, and a buffer space, and the second path is connected to and disconnected from the buffer space.

6. The ink jet recording apparatus according to claim 1, wherein the second path is connected and disconnected at a junction between the first path and the recording head.

7. The ink jet recording apparatus according to claim 5, wherein at least part of a wall that defines the buffer space has a gas-liquid separation film that transmits gas but does not transmit liquid, and gas is discharged from the buffer space through the gas-liquid separation film.

* * * * *